US011530555B2

(12) United States Patent
Perreau et al.

(10) Patent No.: US 11,530,555 B2
(45) Date of Patent: Dec. 20, 2022

(54) TWO-ALARM SHOE TAG

(71) Applicant: CHECKPOINT SYSTEMS, INC., Thorofare, NJ (US)

(72) Inventors: Benoit Perreau, Matthews, NC (US); Joe Galanti, Blackwood, NJ (US); Michael Brody, Philadelphia, PA (US)

(73) Assignee: CHECKPOINT SYSTEMS, INC., Thorofare, NJ (US)

( * ) Notice: Subject to any disclaimer, the term of this patent is extended or adjusted under 35 U.S.C. 154(b) by 0 days.

(21) Appl. No.: 17/297,767

(22) PCT Filed: Nov. 27, 2019

(86) PCT No.: PCT/US2019/063569
§ 371 (c)(1),
(2) Date: May 27, 2021

(87) PCT Pub. No.: WO2020/112972
PCT Pub. Date: Jun. 4, 2020

(65) Prior Publication Data

US 2021/0396051 A1 Dec. 23, 2021

Related U.S. Application Data

(60) Provisional application No. 62/773,624, filed on Nov. 30, 2018.

(51) Int. Cl.
*E05B 73/00* (2006.01)
*G08B 13/24* (2006.01)
*A43C 19/00* (2006.01)

(52) U.S. Cl.
CPC ..... *E05B 73/0017* (2013.01); *A43C 19/00* (2013.01); *G08B 13/2434* (2013.01)

(58) Field of Classification Search
CPC ..... E05B 73/0017; G08B 13/2434; G08B 13/149; G08B 13/2463
See application file for complete search history.

(56) References Cited

U.S. PATENT DOCUMENTS 524,872 A * 8/1894 Stephen ..... C14B 1/26 24/347
4,616,384 A * 10/1986 Lowell ..... F16M 11/105 24/335

(Continued)

FOREIGN PATENT DOCUMENTS

WO 96/14488 5/1996

OTHER PUBLICATIONS

Patent Cooperation Treaty (PCT), International Search Report and Written Opinion for Application PCT/US2019/063569 filed Nov. 27, 2019, dated Mar. 6, 2020, International Searching Authority, EP.

*Primary Examiner* — Hoi C Lau
(74) *Attorney, Agent, or Firm* — McDonald Hopkins LLC

(57) ABSTRACT

Disclosed is a two-alarm security device that will alarm if the security device is forcibly removed from an article or item without detachment by a corresponding detachment device, and the security device will cause the pedestals in a store to alarm if the article or item is passed through the pedestals with the device still attached. The two-alarm security device comprises a slider operatively movable along a stop piece and a spring-biased engagement member that is operatively moveable into the housing of the stop piece. As the slider and engagement member move from an open position to a closed position, the security device alarm is actuated. A pressure pad attached to the engagement member assists in gently, but sufficiently securing an article between the slider and engagement member. If the article is improperly removed from the security device or otherwise (Continued)

tampered with, the spring-biased engagement member will cause a micro-switch to alarm.

25 Claims, 10 Drawing Sheets

(56) References Cited

U.S. PATENT DOCUMENTS 4,903,383 A * 2/1990 Gartshore ..... E05B 73/0017 24/706.6
5,068,641 A * 11/1991 Hogen Esch ..... G08B 13/14 340/551
5,144,820 A * 9/1992 Holmgren ..... E05B 73/0035 351/111
5,365,758 A * 11/1994 Shieh ..... B60R 25/08 188/265
5,379,618 A * 1/1995 Shieh ..... B60R 25/08 70/227
5,655,392 A * 8/1997 Holmgren ..... E05B 73/0017 24/514
5,812,065 A * 9/1998 Schrott ..... G01S 13/753 235/380
6,374,647 B1 * 4/2002 Holmgren ..... E05B 73/0017 70/57.1
6,449,991 B1 * 9/2002 Hogan ..... E05B 73/0017 70/57.1
7,441,424 B2 * 10/2008 Saitoh ..... E05B 73/0017 70/19
7,474,222 B2 * 1/2009 Yang ..... E05B 73/0017 24/704.1
7,481,086 B2 * 1/2009 Fawcett ..... E05B 45/005 242/382
7,595,733 B2 * 9/2009 Spagna ..... E05B 73/0017 24/16 PB
D611,862 S * 3/2010 Perez ..... D10/106.91
7,724,146 B2 * 5/2010 Nguyen ..... E05B 73/0052 340/572.8
8,733,138 B2 * 5/2014 Favier ..... E05B 73/0035 70/57.1
9,404,289 B2 * 8/2016 Sayegh ..... E05B 73/0017
9,637,951 B2 * 5/2017 Luo ..... E05B 73/0017
9,652,954 B2 * 5/2017 Piccoli ..... G08B 13/1463
9,779,600 B2 * 10/2017 Sayegh ..... G08B 13/2434
10,121,342 B2 * 11/2018 Alvarez ..... E05B 73/0064
2004/0257232 A1 * 12/2004 Garner ..... G08B 13/2434 340/572.8
2007/0120686 A1 * 5/2007 Spagna ..... E05B 73/0017 340/572.9
2007/0152836 A1 * 7/2007 Nagelski ..... G08B 13/149 340/572.9
2007/0257098 A1 * 11/2007 Fowler ..... G06Q 30/06 235/375
2007/0296597 A1 * 12/2007 Nizzola ..... G06K 19/047 340/572.8
2008/0061987 A1 * 3/2008 Kolton ..... G02C 11/00 340/572.9
2009/0278691 A1 * 11/2009 Valade ..... E05B 73/0052 340/572.8
2010/0171620 A1 * 7/2010 Stoltz ..... E05B 73/0017 340/572.9
2010/0287998 A1 * 11/2010 Anderson ..... E05B 73/0017 70/57.1
2012/0073336 A1 * 3/2012 Thoonsen ..... E05B 73/0017 70/19
2012/0080526 A1 * 4/2012 Day ..... E05B 73/0017 235/486
2012/0091741 A1 * 4/2012 Stewart ..... E05B 73/0017 292/307 A
2012/0139707 A1 * 6/2012 Stewart ..... G06K 19/041 340/10.1
2012/0204608 A1 * 8/2012 Sayegh ..... E05B 73/0017 70/19
2012/0223145 A1 * 9/2012 Stewart ..... G06K 19/04 235/488
2012/0304710 A1 * 12/2012 Sayegh ..... E05B 73/0029 70/19
2013/0321155 A1 * 12/2013 Nguyen ..... G08B 13/2434 340/572.8
2014/0077954 A1 * 3/2014 Luo ..... G08B 13/2434 340/572.8
2014/0104061 A1 * 4/2014 Luo ..... G08B 13/1445 340/572.8
2015/0048946 A1 * 2/2015 Luo ..... E05B 73/0017 340/572.8
2017/0132891 A1 * 5/2017 Norman ..... G08B 13/2434
2017/0193777 A1 * 7/2017 Sayegh ..... G08B 13/2465
2018/0276964 A1 * 9/2018 Yang ..... G08B 13/2417
2021/0396051 A1 * 12/2021 Perreau ..... E05B 17/22

* cited by examiner

TWO-ALARM SHOE TAG

CROSS-REFERENCE TO RELATED APPLICATION

The present application is a 35 U.S.C. 371 national stage filing and claims priority to International Application No. PCT/US2019/063569 entitled "TWO-ALARM SHOE TAG," filed on Nov. 27, 2019, which claims priority to and the benefit of U.S. Provisional Application No. 62/773,624 filed on Nov. 30, 2018, each of which are incorporated herein by reference in their entireties.

TECHNICAL FIELD

The present disclosure relates to an anti-theft device and, more particularly, to an anti-theft device for use in inventory tracking and anti-theft applications.

BACKGROUND

Conventional hard-tag anti-theft and asset-tracking devices tend to rely on a pin or lanyard system that either extends through the article, such as a shirt or tablecloth, or loop around a portion of the article, such as a ring or handle, to secure the security device thereto. Other conventional anti-theft and asset-tracking devices, such as those used for multimedia, e.g. DVDs, CDs, and the like, utilize an adhesive and attach to an outer, secure packaging such as a plastic wrap. In order to ensure proper securement and to ultimately prevent tampering, these methods of attachment require a malleable fabric, an outer secure packaging, or an opening to accommodate the pin, lanyard, or the like.

Certain consumer items, such as shoes including high-heels, flats, boots, loafers, and the like, cannot be easily tagged and tracked by conventional hard-tags used in anti-theft and asset-tracking applications due to their shape and material. For example, articles made of leather, suede, velvet, wood, plastic, and the like would be damaged by the use of a security tag having a pin or adhesive. Additionally, wearable items, such as shoes, cannot include an outer, secure packaging as that may interfere with the consumer's ability to try on or view the item prior to purchase. Similarly, without a secure portion of the article able to accommodate a lanyard, such as a fixed strap or other opening, the security tag would not be able to be properly secured and may be subject to tampering. Additionally, security devices that are able to attach to the article without a pin, adhesive, or lanyard may still use high clamping pressure to prevent tampering that will still mark, imprint, and damage the article and make the article unsuitable for sale. Additionally, these security devices are often bulky and prevent a consumer's ability to try and/or wear the article.

Thus, there remains a need for an anti-theft and asset-tracking device that may securely attach to an item without causing damage to the item and that will prevent the unauthorized tampering with and removal of the security device. Moreover there is a need for a security device that does not visually obstruct the item and does not interfere with a consumer's ability to try on, sample, or otherwise view the item.

SUMMARY

The following presents a summary of this disclosure to provide a basic understanding of some aspects. This summary is intended to neither identify key or critical elements nor define any limitations of embodiments or claims. Furthermore, this summary may provide a simplified overview of some aspects that may be described in greater detail in other portions of this disclosure.

Disclosed herein is a security tag having a two-alarm system for alarming when an item is removed from a store with the security tag still attached thereto and for alarming when the security device is forcibly removed or otherwise tampered with. The security tag includes a slider that is operatively slidable with a stop piece, and an engagement member positioned on a hollow face of the slider that operatively contacts an arm of the slider and that operatively depresses into the stop piece. The slider and engagement member are each moveable in a lateral direction and between an open or unarmed position and a closed or armed position. A side of an article or item, such as a shoe, may be inserted between the arm of the slider and the engagement member when the security device is in an open position and the side of the item may be secured between the arm of the slider and the engagement member when the security device is moved into a closed position. The slider and stop piece sequentially lock as the slider and stop piece are moved toward a closed position, such that the security device may accommodate a variety of different articles having different shapes, thickness, and sizes. As a result, the "closed" position is dependent on the particular article (or lack thereof). The security device may allow for anti-theft and asset-tracking capabilities of the item due to its two alarming systems.

In an embodiment, A security tag may comprise a slider coupled to a stop piece, wherein the slider is operatively slidable along the stop piece between an armed and an unarmed position; an engagement member that is operatively engageable with an article; and a first alarming mechanism that activates when the stop piece and the slider are in the armed position. The engagement member may be configured to engage the article when the stop piece and the slider are in the armed position. The engagement member may be spring-biased and operatively moveable into the stop piece upon pressure from the slider or article. The engagement member may be depressed into a housing of the stop piece by contact with the slider or article in the armed position. The engagement member may activate the first alarming mechanism in the armed position by activating a switch when depressed into the stop piece.

In an embodiment, unauthorized tampering or removal of the security tag may cause the engagement member to at least partially move from the armed position; wherein unauthorized movement of the engagement member causes the switch to alarm. The engagement member may at least partially extend from a depressed position in the stop piece during unauthorized tampering or removal of the security tag to cause the switch to alarm. The engagement member may be configured to engage the article by a frictional clamping force between the slider and the engagement member. The engagement member may include a pressure plate that comprises a compressible material. In an embodiment, the compressible material of the pressure plate may be selected from a rubber, a silicone material, a foam, or a polyurethane. The compressible material may conform to the contours of the article to which it is attached.

In an embodiment, the security tag further comprises a power mechanism. The power mechanism may include a paddle, an arm attached to a paddle, and a power switch. The paddle may extend outside of the stop piece in an off position, with the arm and power switch within the stop piece. The paddle may be positioned between the slider and the stop piece, and may prevent the slider from sliding on the stop piece to a closed position. The paddle may be pressed into the stop piece, rotating the arm of the paddle inside of the stop piece, until the arm presses the power switch and turns on the power to an on position. When the paddle is pressed into the stop piece into an on position, the slider may be free to slide on the stop piece into a closed position. In an embodiment, the power mechanism ensures the power is only on when the security tag is in a closed position and is most likely to be secured to an article. In an embodiment, the paddle of the power mechanism ensures the slider may not move into a closed position and the power of the security tag may not be turned on inadvertently, such as during shipping, transport, and storage. In am embodiment, the security device may further comprise a paddle that compresses a power switch when pressed into the stop piece in the armed position. The paddle may prevent movement of the slider when extended beyond the stop piece in the unarmed position. The paddle may prevent the security tag from accidentally moving from the unarmed position to the armed position during shipping, transport, or storage.

In an embodiment, the security tag further comprises a locking mechanism. The locking mechanism may include a ratchet rack, a pawl, and a biasing member. The biasing member may be a spring and may attach to the pawl and bias the pawl toward the ratchet rack. The ratchet rack and the pawl may have angular corresponding teeth that allow movement in a single direction. For example, the locking mechanism may allow movement of the slider toward the stop piece from an open to a closed position, but not vice versa. The locking mechanism may prevent movement from a closed to an open position and lock the slider in each subsequent position as the slider moves toward the stop piece. In an embodiment, the security tag may further comprise a ratchet locking mechanism configured to allow movement of the slider along the stop piece in a forward lateral direction toward the stop piece, but prevent movement of the slider along the stop piece in a backward lateral direction away from the stop piece. The ratchet locking mechanism may include a spring-biased pawl that moves in a direction perpendicular to a ratchet track.

In an embodiment, the security tag further comprises an alarm actuation mechanism. The alarm actuation mechanism may include an engagement member, an arm, and a micro-switch. As a slider is moved between an on position and an off position and a side of an item is inserted between an arm of the slider and the engagement member, the engagement member may be compressed by the slider and the side of the article, into a stop piece. As the engagement member is compressed into the stop piece, an arm may compress and activate a micro-switch. In an embodiment, the security tag may use sufficient pressure to hold the side of the item between the arm of the slider and the engagement member, but may not require pressure that may leave an imprint on the item. Instead, if the item is tampered with or forcibly removed without a corresponding detachment device, the engagement member will move and extend further outside the housing, releasing the arm from the micro-switch, and causing the micro-switch to an alarm. In an embodiment, the engagement member further comprises a compressible pad, such as rubber or silicone.

In an embodiment, the security tag may be pin-less. In an embodiment, the security tag may be free of an external loop. In an embodiment, the security tag may be adhesive free. In an embodiment, the security tag may not require one or more of insertion through the article, full 360° circumscription around the article, or adhesive. The security tag, when engaged with the article, may provide a pressure sufficient to attach and secure to the article and activate the switch, but the pressure is such that it does not leave an imprint on or damage the article. In an embodiment, the security tag may further comprise a second alarming mechanism that activates when passed through the security pedestals of a store. In an embodiment, the article may be a shoe. In an embodiment, a user may view, try on, or touch the article and security tag without causing the first alarming mechanism to alarm.

A method of attaching a security tag to an article may comprise (a) pressing a paddle of a power mechanism into a housing of a stop piece to engage a power switch; (b) sliding a slider across a track of the stop piece from an open position toward a closed position; (c) inserting an article between an arm of the slider and an engagement member that that is biased by a spring; (d) sliding the slider along the track the stop piece until the article is secured between the arm of the slider and the engagement member, wherein the engagement member activates a switch and alarms the security device when in the closed position. In an embodiment, the security tag may provide enough pressure to attach and secure to the article and activate the switch, but not so much pressure as to leave an imprint or otherwise damage the article.

The following description and the drawings disclose various illustrative aspects. Some improvements and novel aspects may be expressly identified, while others may be apparent from the description and drawings.

DESCRIPTION OF THE DRAWINGS

The present teachings may be better understood by reference to the following detailed description taken in connection with the following illustrations, wherein.

The present disclosure may be embodied in several forms without departing from its spirit or essential characteristics. The scope of the present disclosure is defined in the appended claims, rather than in the specific description preceding them. All embodiments that fall within the meaning and range of equivalency of the claims are therefore intended to be embraced by the claims.

DETAILED DESCRIPTION

Reference will now be made in detail to embodiments of the present teachings, examples of which are illustrated in the accompanying drawings. It is to be understood that other embodiments may be utilized and structural and functional changes may be made without departing from the scope of the present teachings. Moreover, features of the embodiments may be combined, switched, or altered without departing from the scope of the present teachings, e.g., features of each disclosed embodiment may be combined, switched, or replaced with features of the other disclosed embodiments. As such, the following description is presented by way of illustration and does not limit the various alternatives and modifications that may be made to the illustrated embodiments and still be within the spirit and scope of the present teachings.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggests otherwise.

It is noted that the various embodiments described herein may include other components and/or functionality. It is further noted that while various embodiments refer to a security tag, various other systems may be utilized in view of embodiments described herein. For example, embodiments may be utilized in any kind of security device or tracking device. As such, references to a security tag or security device are interchangeable and understood to include tracking systems, anti-theft devices, asset tracking devices and the like. Further, while certain features may be described as utilized with a specific embodiment, it should be understood that for the sake of brevity any of the functionality and feature of one embodiment may be replace or be added to any of the other embodiments described herein.

Figure 1A:
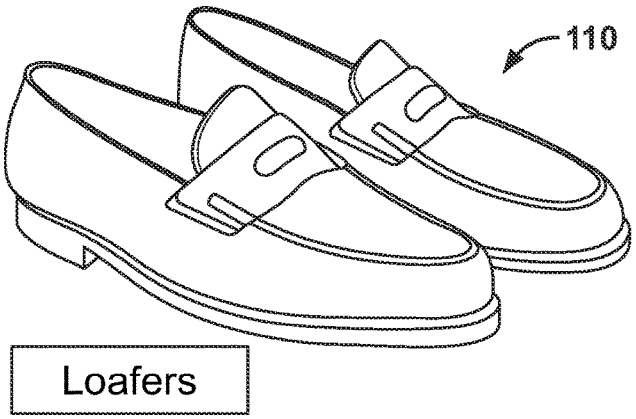
FIG. 1A-D show non-limiting examples of consumer items that may be used with a security tag with FIG. 1D also showing exemplary attachment of an embodiment of a security tag to a consumer item.
Figure 1B:
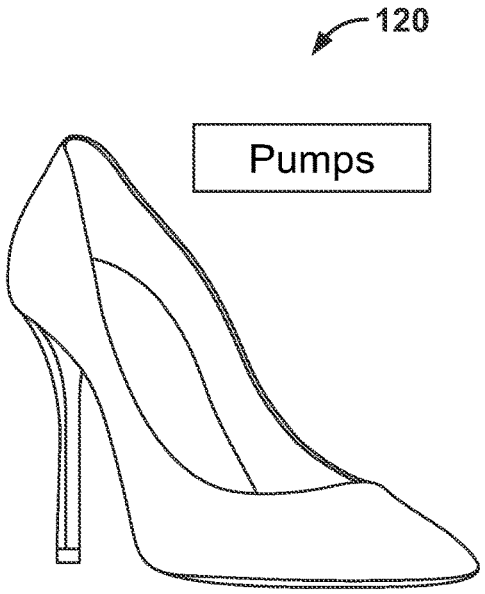
Figure 1C:
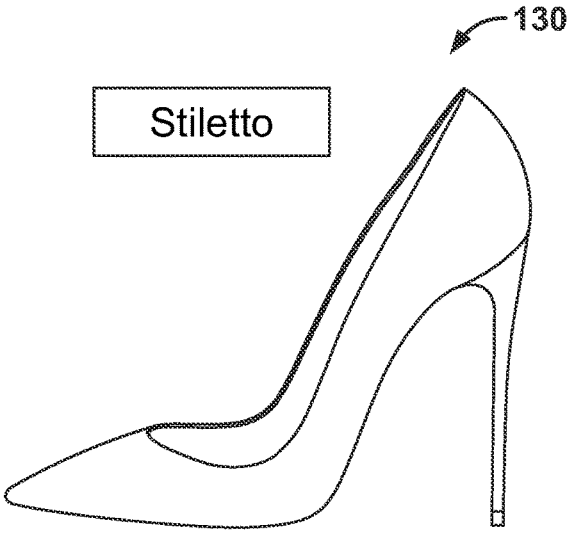
Figure 1D:
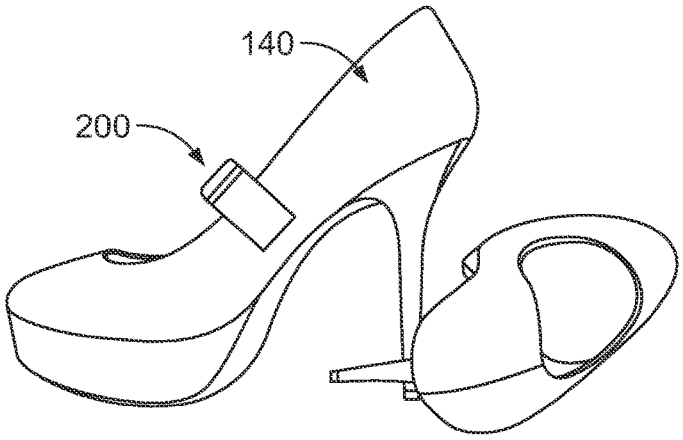

A two-alarm security device 200 for use in inventory tracking and anti-theft applications is described herein. FIGS. 1A-D illustrates non-limiting examples of articles 110, 120, 130, 140 for which the security device 200 may be used. FIG. 1D further illustrates an exemplary attachment of a security device 200 to a consumer item 140. Although the disclosure references shoes as an example of an article suitable for use with the security device 200, it is noted that any item can be used with the security device 200 described herein, including clothing, electronics, homeware, office supplies, accessories, and the like. The security device 200 may be used without the need for a pin, adhesive, lanyard, or the other similar securement mechanism to ensure proper attachment to an article or item, such as a shoe. Instead, the security device 200 clamps onto an article or item with frictional pressure that is sufficient to stay in an operative position during normal use of the article to which it is attached, including shipping, transport, trying on and viewing by a consumer, and the like, but that is minimal enough to avoid a lasting imprint on the article or item when properly removed.

Figure 10:
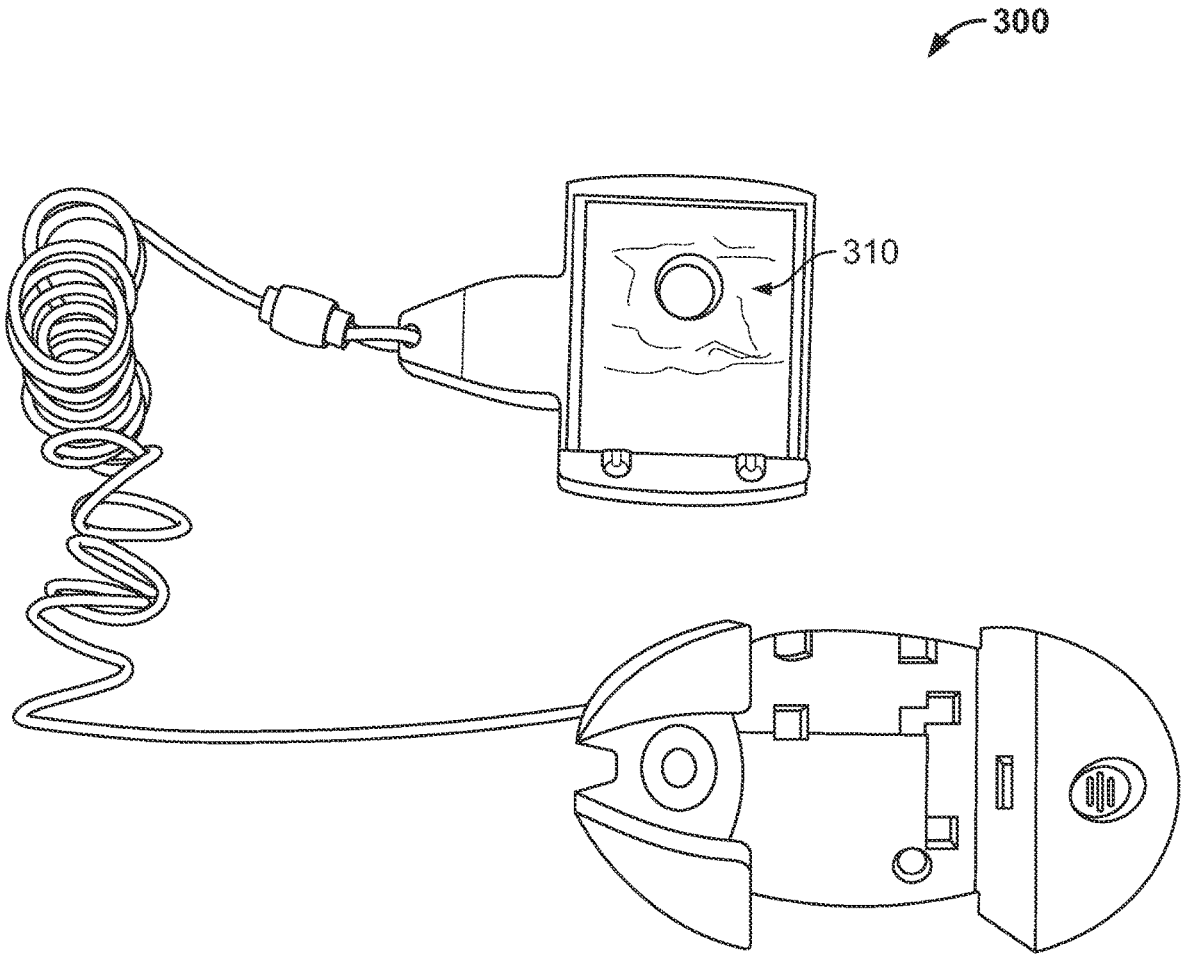
FIG. 10 is a perspective view of an embodiment of a detachment device that may be used with a security tag.

The security device 200 will alarm if the security device 200 is forcibly removed from the article or item without detachment by a corresponding detachment device, such as detachment device 300 shown in FIG. 10. The security device 200 will also cause the pedestals in a store to alarm if the article or item is passed through the pedestals with the security device 200 still attached, thereby incorporating two alarms. In an embodiment, the security device 200 may be pin-less, may be free of an external loop, and may be adhesive free. Moreover, the security device 200 may not require one or more of: insertion through the article, full 360° circumscription around the article, or adhesive. The security device 200, when engaged with the article, may provide a pressure sufficient to attach and secure to the article and activate the switch or alarm the system, but the pressure is such that it will not leave an imprint on or damage the article. In an embodiment, the article may be a shoe. A user may view, try on, or touch the article and security device 200 without causing the first alarming mechanism to alarm.

Figure 2:
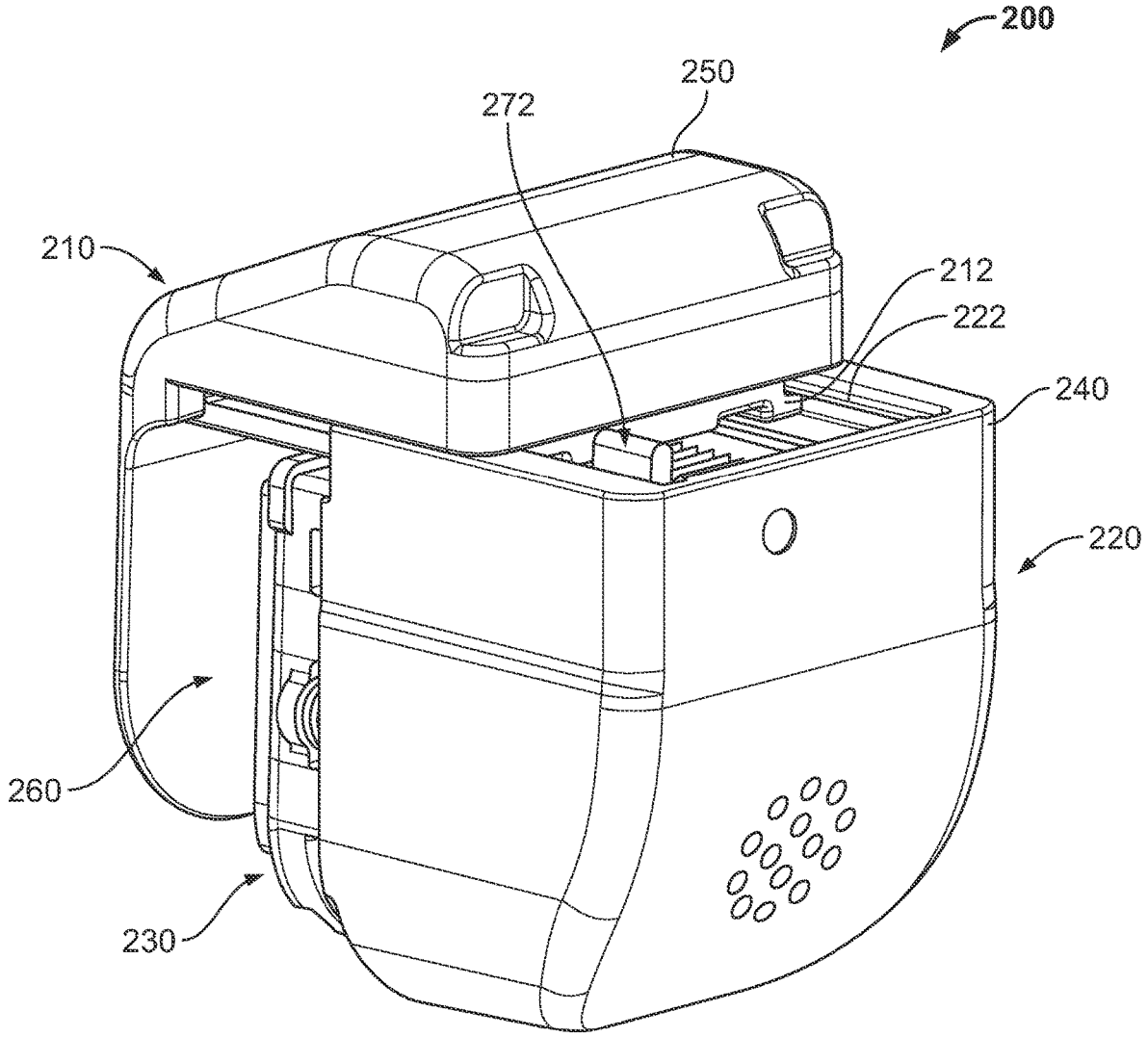
FIG. 2 is a perspective view of an embodiment of a security tag.

Turning to FIG. 2, disclosed is a two-alarm security device 200. The security device 200 comprises a slider 210, a stop piece 220, and an engagement member 230. The slider 210 and stop piece 220 may include housings 240, 250 that surround or circumscribe the internal power, locking, and actuation mechanisms therein. The housings 240, 250 may be monolithically formed or may comprise one or more portions operatively assembled together, such as a top cover and bottom cover and/or or two side covers and a front cover. It is noted that the housings 240, 250 may comprise any appropriate shape and material, such as plastic, rubberized plastic, and the like.

The slider 210 is slidably engagable with the stop piece 220 such that the slider 210 may move in a lateral direction relative to the stop piece 220. For example, the slider 210 may include rails 212 that slidably engage with a track 222 on the stop piece 220. For example, the slider 210 may include a protrusion 212 that slidably engages with a recess 222 on the stop piece 220, or vice versa. The sliding movement of the slider 210 in reference to the stop piece 220 allows the security device 200 to transition between an open position shown in FIG. 8 and a closed position shown in FIG. 9, wherein the security device 200 is unpowered and unarmed in the open position and is powered and armed in the closed position.

Although a slider 210 mechanism is herein described, it is noted that any clamping mechanism or engaging mechanism may be used to transition the security device 200 between open and closed positions. For example, the slider 210 may have rotational movement at a junction between the slider 210 and the stop piece 220. The slider 210 may rotate around an axis at the junction of the slider 210 and the stop piece 220 between open and closed positions. In addition, the slider 210 and stop piece 220 may engage through any appropriate configuration, including, without limitation, through telescoping, sliding, rotating, pivoting, or the like rotation to engage the slider 210 and stop piece 220 as otherwise described herein.

Figure 8:
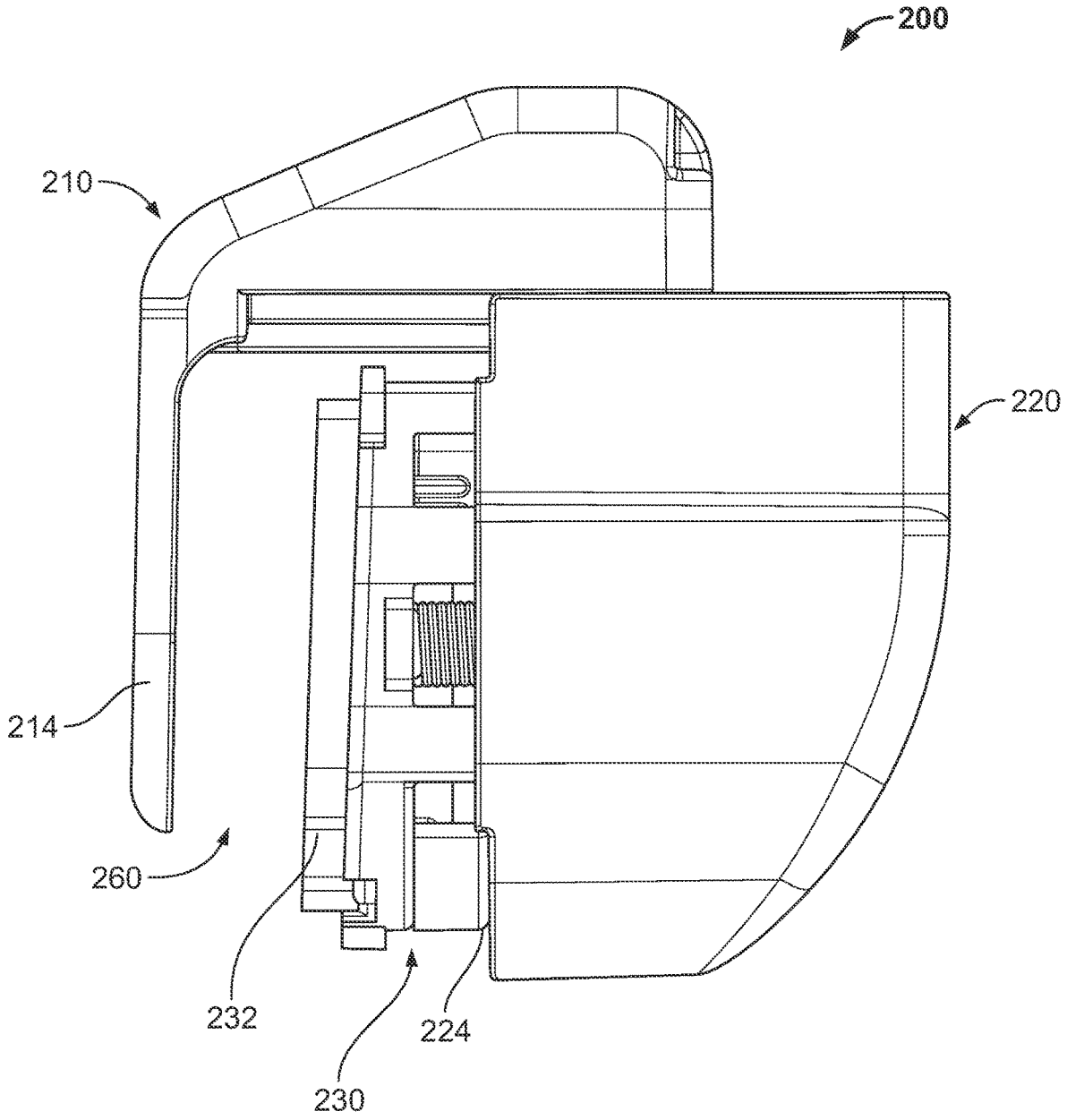
FIG. 8 is a side view of an embodiment of a security tag in an unarmed and power off position.
Figure 9:
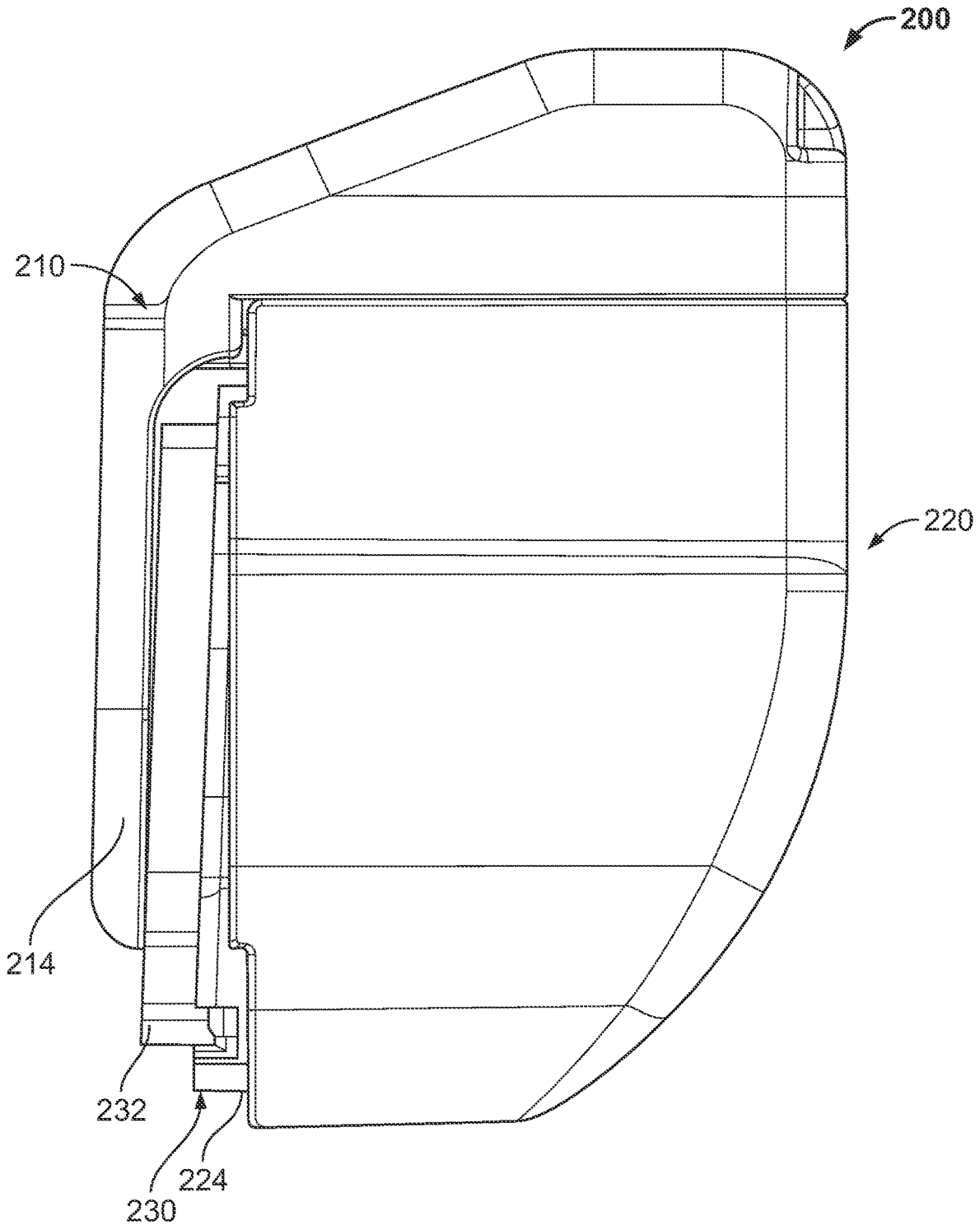
FIG. 9 is a side view of an embodiment of a security tag in an armed and power on position.

This transition between an open and a closed position, as shown in FIGS. 8 and 9, enables securement of an item or article, such as a side of a shoe 110, 120, 130, 140 (the engagement of which is shown in FIG. 1D). The security device 200 may engage the side of a shoe 110, 120, 130, 140 in the space 260 between the slider 210 and stop piece 220 or engagement member 230. The engagement member 230 may be located on a hollow face 224 of the stop piece 220 and may operatively contact an arm 214 of the slider 210 when in a fully closed position and when the security device 200 is not attached to an item or article, as shown in FIG. 9.

The engagement member 230 includes a pressure plate 232 or other frictional component that gently, but securely molds to an article. This may both prevent the unauthorized tampering and removal of the security device 200 and prevent damage to the article, such as leaving a lasting imprint, when the security device 200 is removed by a corresponding detachment device 300. The pressure plate 232 may include a rubber or rubber-like material, such as silicone. Other suitable materials may include silicone sponges or foams, polyurethane, natural rubbers, and the like. It is noted that a pressure plate 232 may be included on the engagement member 230, the arm 214 of the slider 210, or both, to secure an article therebetween. The engagement member 230 is also moveable in a lateral direction relative to the stop piece 220 from an open position shown in FIG. 8, where the security device 200 is unpowered and unarmed, to a closed position shown in FIG. 9, where the security device 200 is powered and armed, similar to that of the slider 210.

Figure 3:
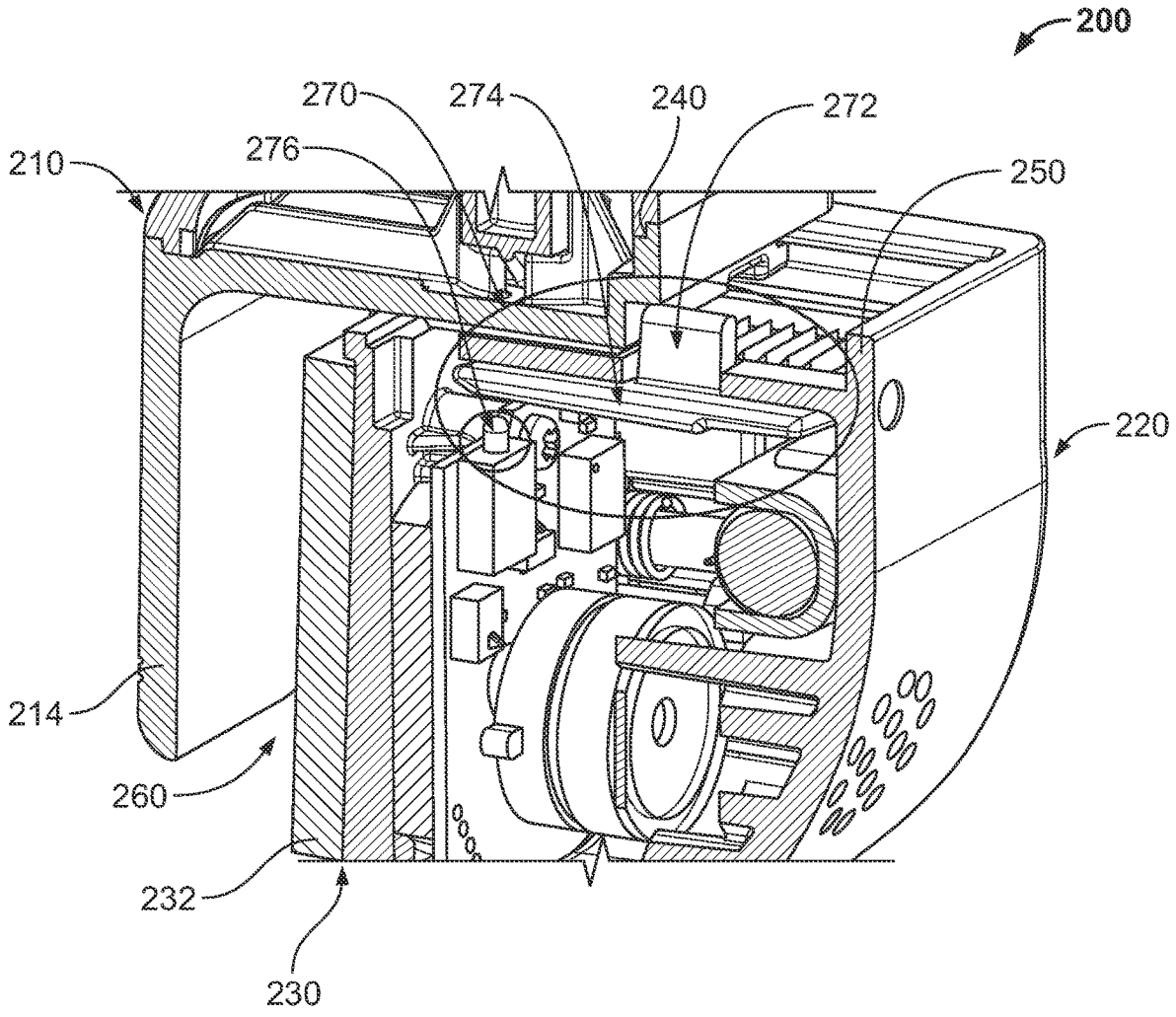
FIG. 3 is a cross-sectional side view of an embodiment of a security tag having a power switch in an off position.
Figure 4:
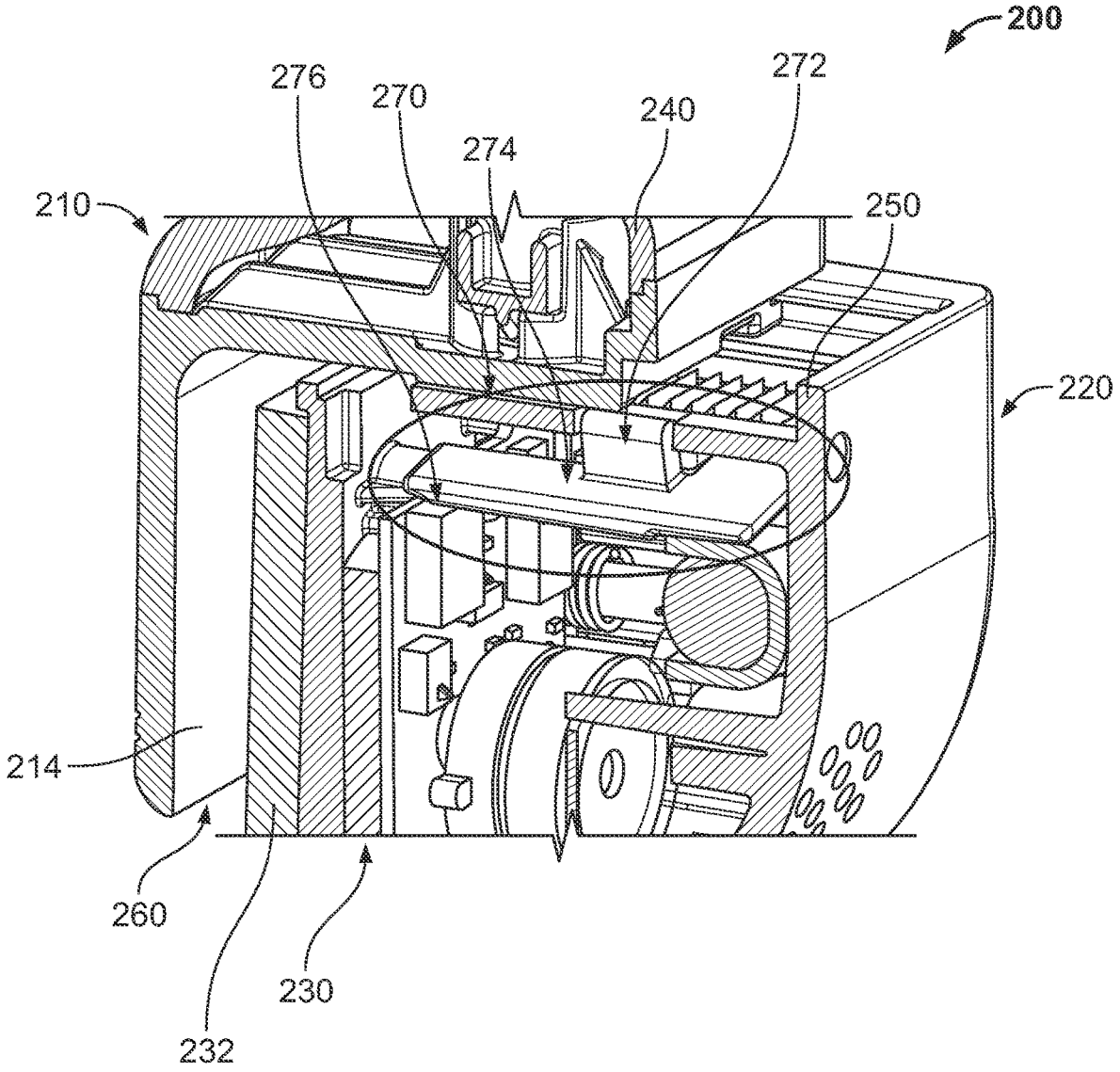
FIG. 4 is a cross-sectional side view of an embodiment of a security tag having a power switch in an on position.

In order to arm the security device 200 and secure an article therein, the security device 200 first includes a power mechanism 270 as shown in FIGS. 3 and 4. The power mechanism 270 may comprise a paddle 272 and a power switch 276. When in a power off position, as shown in FIG. 3, the paddle 272 extends above the housing 250 of the stop piece 220 and into the track 212 of the stop piece 210. In an embodiment, the slider 210 may itself press the paddle 272 to engage the power mechanism 270 as the slider 210 is moved to a closed position.

In another embodiment, the paddle 272 must be pressed by another force, such as by a user. The paddle 272, extending outside of the housing 250 of the stop piece 220 into the track 212 of the stop piece, may prevent the slider 210 from moving along the track 212 of the stop piece 220. As a result, the paddle 272 may prevent movement of the slider 210 toward the stop piece 220 to avoid unintentional powering, locking, and/or arming of the security device 200 during, for example, manufacturing, shipping, transport, or storage.

A user may press the paddle 272 into and below the housing 250 of the stop piece 220 to a power on position as shown in FIG. 4. In this position, the paddle 272 rotates a bar or arm 274, which in turn, may press a power switch 276 to turn the security device on 200. When the paddle 272 is pressed into the housing 250 of the stop piece 220 to turn on the power switch 276, the slider 210 is thereby free to slide along the stop piece 220 into a closed position as shown in FIG. 9. In an embodiment, the movement of the slider 210 holds down the paddle 272 and arm 274 to ensure the power is on only when the slider 210 is in a closed position (i.e., when the slider 210 is no longer in an open position). For example, if a user presses the paddle 272 and then releases the paddle 272 without moving the slider 210, the power will turn back off as the paddle 272 moves back into its original position extending outside of the housing 250 of the stop piece 220. The paddle 272, and thereby the power switch 276, must remain depressed either by the force of a user or by the slider 210 being moved from an open position, for the power of the security device 200 to remain in a power on position.

Figure 5:
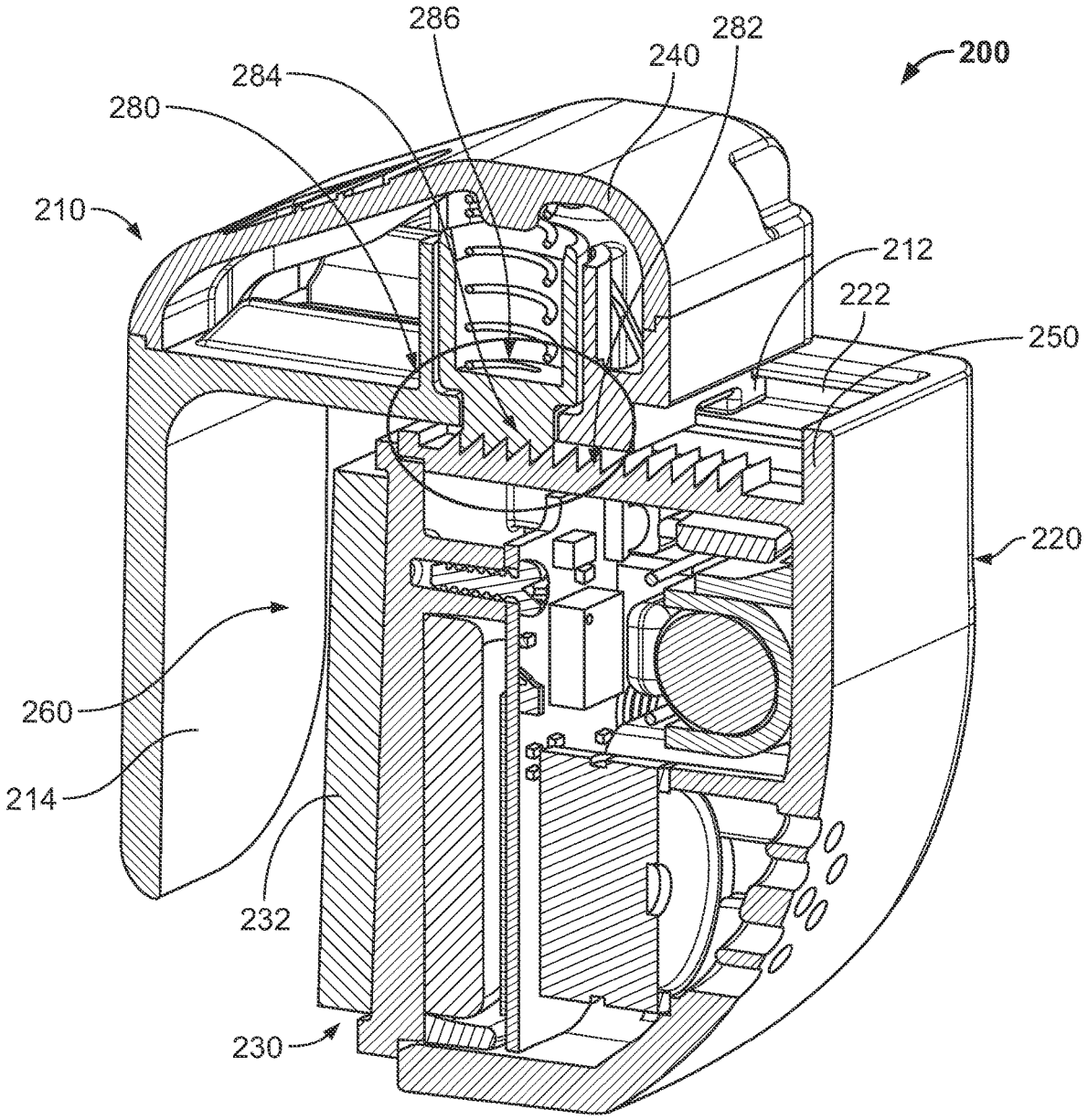
FIG. 5 is a cross-sectional side view of an embodiment of a security tag having a ratchet mechanism.

The slider 210 and stop piece 220 are further engagable by a locking mechanism 280 as shown in FIG. 5. In an embodiment, the locking mechanism comprises a ratchet rack 282 and pawl 284, wherein the pawl 284 is biased by a biasing member 286 to engage with the ratchet rack 282. In an embodiment, the biasing member 286 may comprise a spring. The ratchet rack 282 and pawl 284 may include angled teeth 288 that generally allow motion of the slider 210 between an open position and a closed position, but that will not allow motion of the slider 210 backwards from a closed position to an open position. In an embodiment, the pawl 284 and biasing member 286 are located in the housing 240 of the slider 210 and the ratchet rack 282 is located in the housing 250 of the stop piece 220. It is noted, however, that the mechanism may be switched with the pawl 284 and biasing member 286 located in the stop piece 220 and the ratchet rack 282 located in the slider 210. In an embodiment, the pawl 284 may move linearly in a direction that is generally perpendicular to the ratchet rack 282 and engage with the ratchet rack 282 due to its biasing member 286.

As the slider 210 moves toward the stop piece 220, the angular teeth of the ratchet rack 282 and pawl 284 engage and effectively lock the security device 200, allowing the slider 210 to potentially move further toward the stop piece 220 and to a closed position, but preventing any other movement backwards away from the stop piece 220 and back toward an open position without a corresponding detachment device 300. Since the ratchet locking mechanism 280 allows for sequential and adjustable locking as the pawl 284 is moved laterally across the ratchet rack 282, the security device 200 is adjustable and can accommodate any type of article or item, such as a shoe, having any material, thickness, and geometry. In an embodiment, the detachment device 300 may include a magnet 310 that aligns with ferrous material on the pawl 284 and pulls up the pawl 284 from the ratchet rack 282 to allow movement of the slider 210 backwards from the stop piece 220 toward an open position. In an embodiment, the detachment device 300 is an S3 key.

Figure 6:
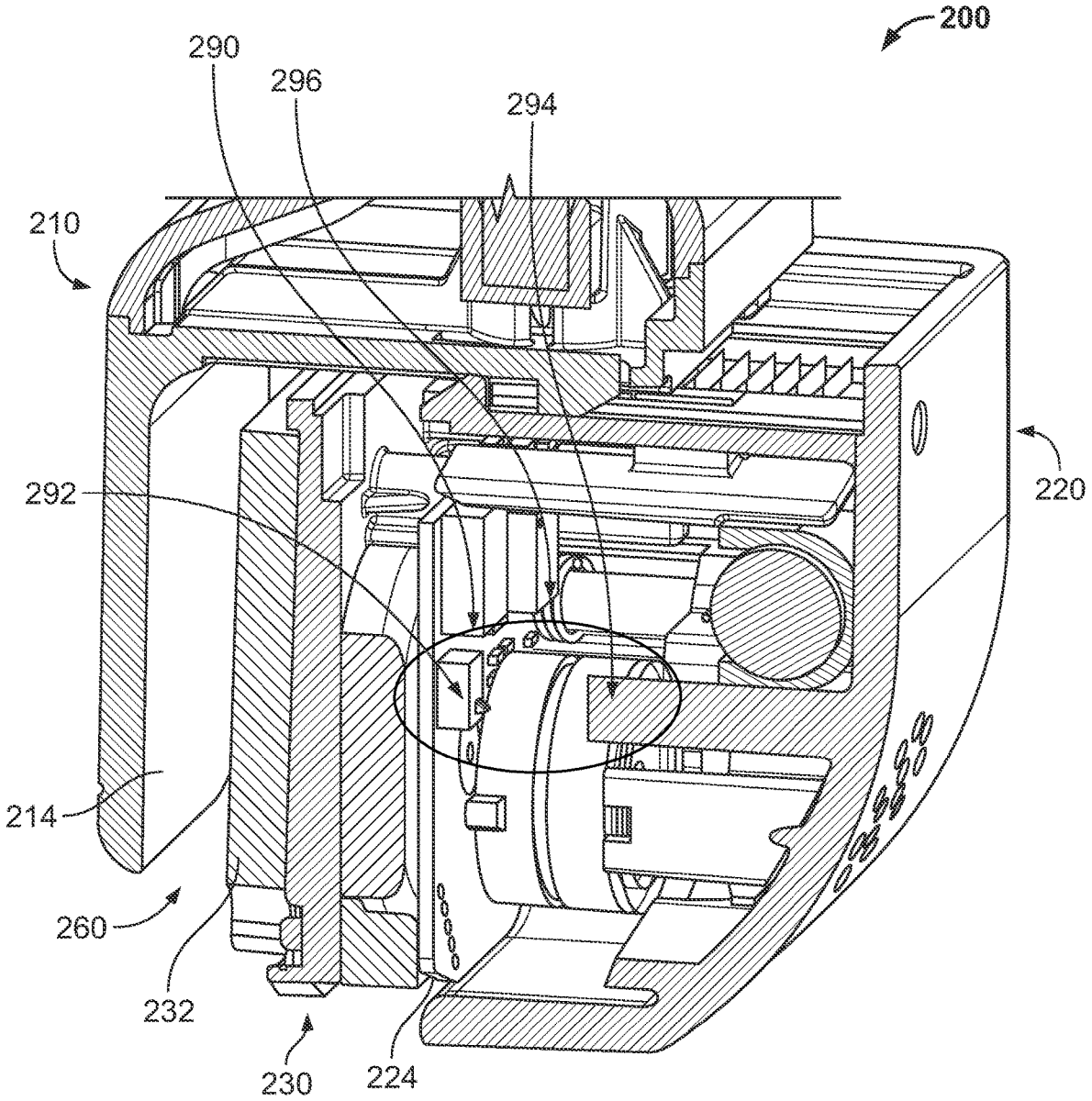
FIG. 6 is a cross-sectional side view of an embodiment of a security tag having a micro-switch mechanism in an open position.
Figure 7:
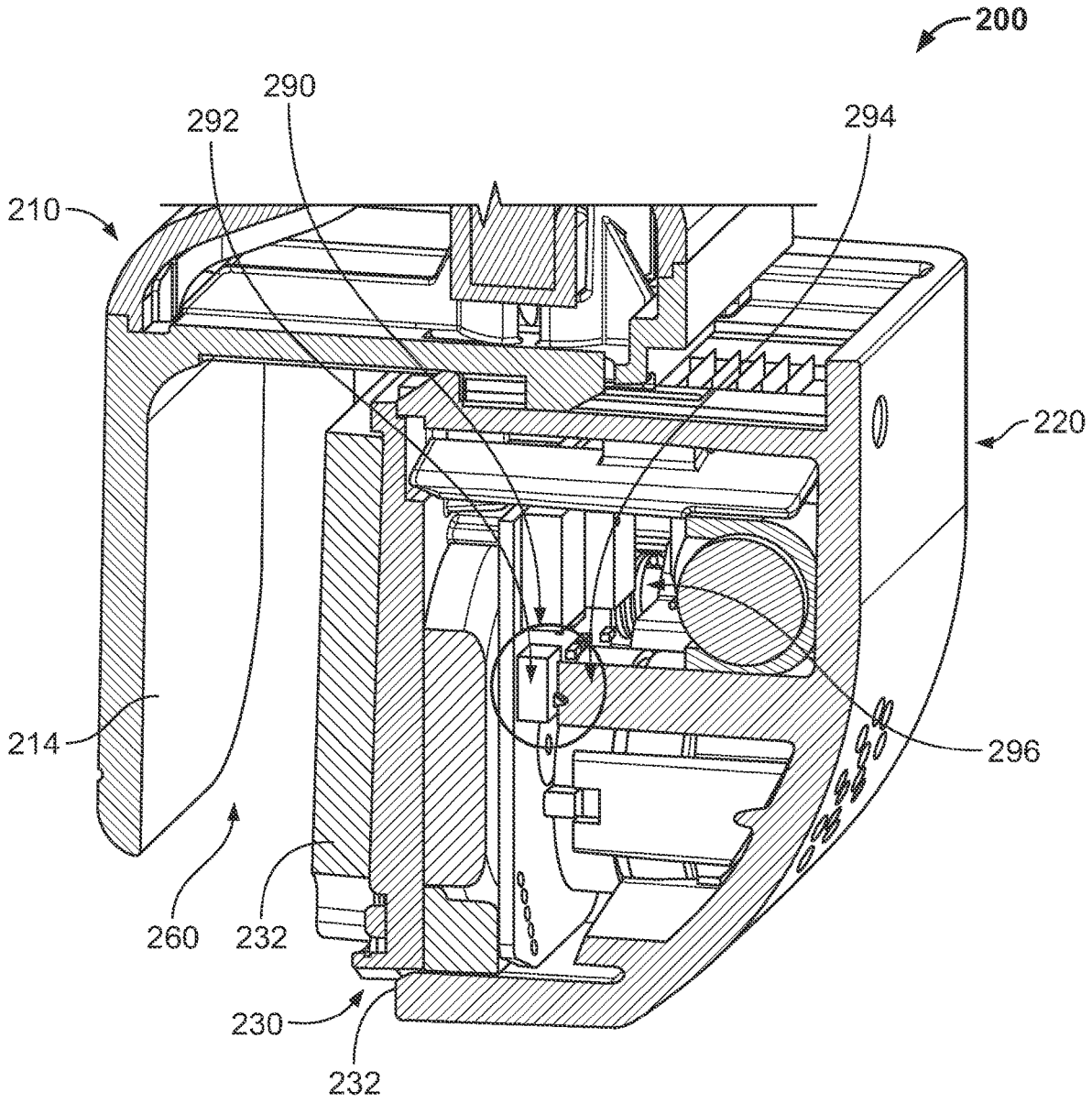
FIG. 7 is a cross-sectional side view of an embodiment of a security tag having a micro-switch mechanism in a closed position.

As illustrated in FIGS. 6 and 7, the security device may further comprise an alarming mechanism 290 including a micro-switch 292 and an arm 294 that actuates the micro-switch 292 to prevent tampering with the security device 200. In an embodiment, the engagement member 230, which is located on a hollow face 224 of the stop piece 220, may be biased through the use of a biasing member 296, such as a spring, against the stop piece 220. As a result, when an article, such as a side of a shoe, or arm 214 of the slider 210 comes into contact with the engagement member 230 or pressure pad 232, the engagement member 230 may also move in a lateral direction relative to the stop piece 220 in the same direction as the slider 210. In an embodiment, the alarming mechanism 290, pressure plate 232, and engagement member 230 may ensure the security device 200 maintains minimal clamping pressure on the article so that no damage is done to the article. The alarming mechanism 290, pressure plate 232, and engagement member 230 may also ensure that sufficient clamping pressure is applied on the article so that the security device 200 remains on the article and may stay in place during normal use, including shipping, transport, trying on and viewing by a consumer, and the like.

As the slider 210 and engagement member 230 are transitioned from an open position as shown in FIG. 6 to a closed position as shown in FIG. 7, the movement of the engagement member 230 actuates the actuation mechanism 290. In an embodiment, the micro-switch 292 is located on a side of the engagement member 230 facing the stop piece 220 and on the side opposite the pressure plate 232. The arm 294 is located opposite the micro-switch 292 on the housing 250 of the stop piece 220. It is noted that the reverse configuration may also be utilized where the arm 294 is located on the engagement member 230 and the micro-switch 292 is located in the stop piece 220. As the engagement member 230 moves to a closed position and withdraws into the housing 250 of the stop piece 220, the arm 296 engages and activates the micro-switch 292.

The micro-switch 292 will alarm if the engagement member 230, by its biasing member 296, moves enough to disengage the arm 294 from the micro-switch 292, i.e., if the article inserted between the arm 214 of the slider 210 and pressure pad 232 of the engagement member 230 is forcibly removed or otherwise tampered with, thereby relieving pressure on the biasing member 296 and moving the engagement member 230 toward an open position where the micro-switch 292 is no longer compressed or no longer as compressed as it was in its particular alarmed position. When the micro-switch 292 is no longer compressed due to tampering or forcible removal of the security device 200 from an article, the micro-switch 292 will alarm. In an embodiment, the alarming micro-switch 292 negates the need for significant or excessive clamping pressure of the article in the security device 200. Since the security device 200 will alarm when tampered with in a store, pressure of the security device 200 is needed only to ensure sufficient securement in normal use. Unlike anti-theft clamping tags that do not include this alarm, the security device 200 is intended to not damage the article or leave lasting imprints on the article.

Although a micro-switch 292 activation mechanism is herein described, it is noted that any activation mechanism may be used to transition the security device 200 into an alarmed state. For example, rather than physical actuation, a light sensor switch may be used. When in an open position, light may contact the light sensor. This light may be ambient light filtering through and into the housing of the stop piece 220 or the slider 210 or another light, such as LED, that may be utilized as a component of the stop piece 220 or slider 210. As the security device 200 is transitioned into a closed position, the light path may be prevented from reaching the light sensor by an inhibitor component, thereby activating the light sensor. In an example, ambient light from outside the security device 200 is able to initially contact the light sensor in an open position through, for example, an opening in the housing of the stop piece 220 or slider 210; as the security device 200 is closed, the slider or another inhibitor component of the security device may enter into the path of the ambient light, such as by covering the opening, and prevent the ambient light from reaching the light sensor. Similarly, another light source, such as an LED may be incorporated into the housing of the stop piece 220 or slider 210. If the security device is tampered with or removed without a corresponding disengagement key, the inhibitor component may move slightly and allow light, such as the ambient or LED lighting, to reach the light sensor and cause the light sensor to alarm.

The security device 200, in addition to the benefits described herein, may be relatively small and compact. Unlike anti-theft devices that rely on large and bulky profiles to physically secure and lock the anti-theft device to an article, where the physical securement is the only protection against tampering, the security device 200 may also physically secure and lock to an article, but may also include an alarming system sensitive to tampering and removal of the security device, which may allow for a smaller and more compact profile. The security device, due to its size, shape, method of attachment, and method of use, may not obstruct the visual impact of the article or shoe, may not interfere with a consumer's ability to try on and wear the article or shoe, and may not prevent the article or shoes from fitting in their original carton. Additionally, the security device 200 may be attached and removed using a single hand and may be cost effective to produce due to the size, materials, and system underlying the security device 200. The security device 200 may be reprogrammed and reused, and may include a second alarming system to alarm if the article is removed from a store with the security device 200 still attached. The security device 200 may also include general asset-tracking capabilities and product identification, including those related to RFID or EAS technologies.

A method of arming the security device 200 is as follows: begin by pressing a paddle 272 of a power mechanism 270 into a housing 250 of a stop piece 220 to rotate an arm of a paddle 274 and engage a power switch 276, effectively turning the security device 200 on. After the paddle 272 is pressed into the housing 250 of the stop piece 220, a slider 210 is able to be slid across a track 222 of the stop piece 220. In an embodiment, the security device 200 utilizes a locking system 280 having a ratchet track 282, spring-biased pawl 284, and a biasing member 286, such as a spring, to lock the slider 210 as it moves from an open position to a closed position. An article may be inserted between an arm 214 of the slider 210 and an engagement member 230 that may comprise a pressure plate 232 and that is biased by a biasing member 296, such as a spring. The slider 210 may be slid along the track 222 of the stop piece 220 until the article is secured between the arm 214 of the slider 210 and the pressure plate 232 and until the engagement member 230 is compressed into the housing 250 of the stop piece 220. As the engagement member 230 is compressed into the housing 250 of the stop piece 210 to a closed position, the movement activates a micro-switch 292 and alarms the security device 200.

A method of unarming the security device 200 is as follows: (1) utilize a corresponding magnetic key 300 to disengage the spring-biased pawl 284 of the locking mechanism 280 from the ratchet track 282, (2) freely move the slider 210 along the track 222 of the stop piece 220 backwards towards an open position, which releases the article secured between the arm 214 of the slider 210 and the pressure plate 232 of the spring-biased engagement member 230 and which releases the engagement member 230 from the housing 250 of the stop piece 220 and unarms the micro-switch 292. As the slider 210 is moved back to an open position, the spring-biased power mechanism 270 may rotate back to its original position, disengaging the power switch 276 and releasing the paddle 272 from the housing 250 of the stop piece 220. Once the power switch 276 is released, the micro-switch 292 may be prevented from alarming even though the arm 294 is no longer compressing the micro-switch 292.

What has been described above includes examples of the present specification. It is, of course, not possible to describe every conceivable combination of components or methodologies for purposes of describing the present specification, but one of ordinary skill in the art may recognize that many further combinations and permutations of the present specification are possible. Each of the components described above may be combined or added together in any permutation to define embodiments disclosed herein. Accordingly, the present specification is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A security tag comprising:

a slider coupled to a stop piece, wherein the slider is operatively slidable along the stop piece between an armed and an unarmed position;

an engagement member that is operatively engageable with an article; and a first alarming mechanism that activates when the stop piece and the slider are in the armed position;

wherein the engagement member (i) is spring-biased and operatively moveable into the stop piece upon pressure from the slider or article; (ii) is configured to engage the article by a frictional clamping force between the slider and the engagement member, or (iii) includes a pressure plate that comprises a compressible material.

2. The security tag of claim 1, wherein the engagement member is configured to engage the article when the stop piece and the slider are in the armed position.

3. The security tag of claim 1, wherein the engagement member is depressed into a housing of the stop piece by contact with the slider or article in the armed position.

4. The security tag of claim 1, wherein the engagement member activates the first alarming mechanism in the armed position by activating a switch when depressed into the stop piece.

5. The security tag of claim 1, wherein unauthorized tampering or removal of the security tag causes the engagement member to at least partially move from the armed position; wherein unauthorized movement of the engagement member causes the switch to alarm.

6. The security tag of claim 1, wherein the engagement member at least partially extends from a depressed position in the stop piece during unauthorized tampering or removal of the security tag to cause the switch to alarm.

7. The security tag of claim 1, wherein when the engagement member includes a pressure plate comprising a compressible material, the compressible material of the pressure plate is selected from a rubber, a silicone material, a foam, or a polyurethane.

8. The security tag of claim 1, wherein when the engagement member includes a pressure plate comprising a compressible material, the compressible material conforms to the contours of the article to which it is attached.

9. The security tag of claim 1, wherein the security tag is pin-less.

10. The security tag of claim 1, wherein the security tag is free of an external loop.

11. The security tag of claim 1, wherein the security tag is adhesive free.

12. The security tag of claim 1, wherein the security tag, when engaged with the article, provides a pressure sufficient to attach and secure to the article and activate the switch, but the pressure is such that it does not leave an imprint on or damage the article.

13. The security tag of claim 1, wherein the security tag further comprises a ratchet locking mechanism configured to allow movement of the slider along the stop piece in a forward lateral direction toward the stop piece, but prevent movement of the slider along the stop piece in a backward lateral direction away from the stop piece.

14. The security tag of claim 13, wherein the ratchet locking mechanism includes a spring-biased pawl that moves in a direction perpendicular to a ratchet track.

15. The security tag of claim 1, wherein the security device further comprises a paddle that compresses a power switch when pressed into the stop piece in the armed position.

16. The security tag of claim 15, wherein the paddle prevents movement of the slider when extended beyond the stop piece in the unarmed position.

17. The security tag of claim 15, wherein the paddle prevents the security tag from accidentally moving from the unarmed position to the armed position during shipping, transport, or storage.

18. The security tag of claim 1 further comprising a second alarming mechanism that activates when passed through the security pedestals of a store.

19. The security tag of claim 1, wherein the article is a shoe.

20. The security tag of claim 1, wherein a user may view, try on, or touch the article and security tag without causing the first alarming mechanism to alarm.

21. A method of attaching a security tag to an article, comprising:

(a) pressing a paddle of a power mechanism into a housing of a stop piece to engage a power switch;

(b) sliding a slider across a track of the stop piece from an open position toward a closed position;

(c) inserting an article between an arm of the slider and an engagement member that that is biased by a spring;

(d) sliding the slider along the track the stop piece until the article is secured between the arm of the slider and the engagement member, wherein the engagement member activates a switch and alarms the security device when in the closed position.

22. The method of claim 21, wherein the security tag provides enough pressure to attach and secure to the article and activate the switch, but not so much pressure as to leave an imprint or otherwise damage the article.

23. A security tag comprising:

a slider coupled to a stop piece, wherein the slider is operatively slidable along the stop piece between an armed and an unarmed position;

an engagement member that is operatively engageable with an article; and a first alarming mechanism that activates when the stop piece and the slider are in the armed position; wherein the security tag is pin-less.

24. A security tag comprising:

a slider coupled to a stop piece, wherein the slider is operatively slidable along the stop piece between an armed and an unarmed position;

an engagement member that is operatively engageable with an article;

a first alarming mechanism that activates when the stop piece and the slider are in the armed position; and a ratchet locking mechanism configured to allow movement of the slider along the stop piece in a forward lateral direction toward the stop piece, but prevent movement of the slider along the stop piece in a backward lateral direction away from the stop piece, wherein the ratchet locking mechanism includes a spring-biased pawl that moves in a direction perpendicular to a ratchet track.

25. A security tag comprising:

a slider coupled to a stop piece, wherein the slider is operatively slidable along the stop piece between an armed and an unarmed position;

an engagement member that is operatively engageable with an article;

a first alarming mechanism that activates when the stop piece and the slider are in the armed position; and a paddle that compresses a power switch when pressed into the stop piece in the armed position.

* * * * *